United States Patent [19]

Vetter

[11] 4,179,529

[45] Dec. 18, 1979

[54] METHOD OF LUBRICATING A THERMOPLASTIC RESIN STRAND FOR SLIDING CONTACT IN A RESHAPING DEVICE

[75] Inventor: Heinz Vetter, Rossdorf, Fed. Rep. of Germany

[73] Assignee: Rohm GmbH, Darmstadt, Fed. Rep. of Germany

[21] Appl. No.: 885,903

[22] Filed: Mar. 13, 1978

[30] Foreign Application Priority Data

Mar. 24, 1977 [DE] Fed. Rep. of Germany ..... 2712874

[51] Int. Cl.[2] ..... B05D 3/06

[52] U.S. Cl. ..... 427/44; 264/22; 264/137; 264/236; 427/54.1; 252/9; 252/11; 252/56 R; 264/289.3; 264/290.7; 427/53.1

[58] Field of Search ..... 427/44, 53, 54; 264/22, 264/137, 236, 210 R

[56] References Cited

U.S. PATENT DOCUMENTS

| | | | |
|---|---|---|---|
| 3,719,539 | 3/1973 | Lamb et al. | 264/236 |
| 3,728,147 | 4/1973 | Jenkins et al. | 427/44 |
| 3,770,490 | 11/1973 | Parker | 427/54 |
| 4,049,757 | 9/1977 | Kammel et al. | 264/236 |
| 4,085,187 | 4/1978 | Jenks et al. | 264/210 R |
| 4,091,123 | 5/1978 | Ayusawa et al. | 427/44 |

*Primary Examiner*—John H. Newsome

*Attorney, Agent, or Firm*—Curtis, Morris & Safford

[57] ABSTRACT

A method is disclosed for lubricating surfaces which are in temporary frictional contact which comprises introducing between said surfaces a lubricating liquid which can be solidified by heat or radiation and, after said temporary contact is broken, then solidifying said liquid by heating said surfaces or exposing said surfaces to radiation.

10 Claims, No Drawings

METHOD OF LUBRICATING A THERMOPLASTIC RESIN STRAND FOR SLIDING CONTACT IN A RESHAPING DEVICE

The present invention relates to a method of lubrication.

Particularly in shaping processes, lubricants are needed which will minimize friction between large surface areas at low shear velocities and at high pressures. The lubricant or slip agent is in these cases always effective only for short periods of time, since at the end of the shaping process the surfaces coated with the lubricant or slip agent are separated one from another.

In forming sheet metal or thermoplastic synthetic resins, highly viscous oils and fats have heretofore previously been employed as lubricants. After use, they must be washed off from the surfaces of the formed piece with the aid of organic solvents. The use of organic solvents brings a number of problems with it: They are expensive, in most cases they are inflammable or toxic and, after use, they must be purified by distillation or burned.

Water soluble lubricants and slip agents, for example lubricating soaps or the highly viscous aqueous polymer solutions known from German Offenlegungsschrift No. 2,459,306 have the advantage, in comparison with oils and fats, that they can be washed with water from surfaces that are coated therewith. In this way, to be sure, many of the problems linked with the use of organic solvents are obviated. Nevertheless, the washing process and subsequent drying require considerable labor and create problems concerning disposal of the waste water.

The object of the present invention is the development of lubricants or slip agents which can be used on large surfaces at high pressures and at low shear velocity and which, after a short period of use, permit surfaces covered therewith to be put into a dry condition without an expensive washing process.

The solution of this problem has been found in the use, as a short-term effective lubricant or slip agent, of a liquid which can be hardened by heat and/or radiation to form a solid. The period of use of the fluid lubricant or slip agent can be from several seconds to some minutes and exceeds an hour only in exceptional cases. The lubricant or slip agent, if its lubricant effect is no longer required and the surfaces to be lubricated have been separated from one another, is not removed in a liquid condition as heretofore, but is transformed into a solid coating which is either permitted to remain on the surfaces or is removed therefrom with simple mechanical means. In this way, all washing and drying processes are obviated, together with difficulties arising from disposal of a washing liquid.

There are a large number of liquids that are converted to a solid condition under the influence of heat, of catalysts, or of suitable radiation. Examples of liquid which can be hardened by the influence of heat are the liquid epoxy resins, alkyd resins, or aminoplast resins, to the extent that they contain little or no non-hardenable solvents, as well as gellable plastisols which comprise a liquid plasticizer and polymer particles, particularly PVC, dispersed therein. Liquid resins having a content of free-radical polymerizable groups, for example methacrylate syrups, unsaturated polyester resins in combination with styrene, unsaturated oilalkys, and acrylate esters or methacrylate esters of polyols, harden under the influence of energy-rich radiation. When combined with materials thermally forming free radicals, these liquid resins can also be hardened by the influence of heat alone. The liquids mentioned here have heretofore been employed as casting resins and coating and impregnating agents. The invention for this reason can be realized in extraordinarily manifold ways. The desired lubricant effect or slip effect can be achieved with practically every material which is liquid at the temperatures used. In order for the film of lubricant or slip agent to give the required low friction value, a minimum film thickness must be maintained in use. This is true above all, if the lubricant film must bear high loads or if a high pressure is involved and the lubricant can be lost by leakage currents. In most cases, the stability of the lubricant film is assured by a high viscosity of the lubricant or slip agent. Preferably, it is in the region from 1–500 Pa.s at the temperature at which it is used.

The conversion of the lubricant or slip agent into a solid should occur at temperatures above the temperature of use or under the influence of suitable radiation. If the conversion is effected solely by heat, the conversion temperature must be sufficiently removed from the temperature of use, by at least 20° C. and preferably by 50° C. or more. The heat can be created in any desired fashion, for example by hot air and preferably by heat radiation. If high temperatures are already involved in the use of the lubricants or slip agent, it is suitable to effect hardening by suitable radiation. For this purpose, visible and ultra-violet light, electron radiation, X-rays, or nuclear radiation can be employed. UV light or, optionally, visible light is particularly preferred because of the minimum technical requirements and minimal danger.

Above all, hardening has the goal of rendering the surfaces which are coated with the lubricant or slip agent dry and clean to the touch, and to avoid the transfer of liquid slip agent to other objects. In order to achieve this goal, it is sufficient to convert the lubricant or slip agent into a gel condition. In general, however, a more complete hardening to form a rubber-elastic, tough-hard or, even brittle-hard condition is preferred. A rubbery-elastic condition is advantageous if the hardened layer of lubricant or slip agent does not adhere tightly to the surface and can be pulled off as a film. In this case, the surface remains in a completely clean and dry condition. However, it can also be desired to leave the hardened film of lubricant or slip agent as a protective coating or as a base coating for further coatings on the surface. In these cases, hardening to a tough-hard or brittle-hard condition is preferred.

The large number of known hardenable liquids permits the choosing of lubricants and slip agents of every desired viscosity and every degree of hardenability for the purposes of the invention. The choice nevertheless is in many cases restricted by factors which are not directly connected with the lubricant effect or hardenability. Thus, the material must not have a corrosive effect on the substances with which it comes into contact. In many cases it is necessary that the agent be involatile, non-inflammable, and non-poisonous, and that it not have an offensive odor. Finally, a low price is of value. Of course it is not always possible to fulfill all of these demands at the same time.

The agent in every case contains a hardenable component and a liquid component. These components can be identical. Examples of materials which are hardenable solely by heat are the bisepoxides and lower polyepoxy compounds and aminoplast resins precondensates and phenoplast resins precondensates. To the extent these materials are not themselves liquid at the temperature at which they are used, they can be employed to the form of solutions in organic solvents or plasticizers. The amount of the nonhardenable additives, however, must be only so large that on hardening at least a gel-like solid which does not separate into a liquid and a solid phase is still formed.

As the hardenable components, ethylenically mono-saturated or poly-unsaturated compounds which can be polymerized by free radicals to form a solid are employed to particular advantage. The formation of radicals for the purpose of hardening can be accomplished in different ways. Thus, polymerization initiators which decompose to form free radicals at a temperature above the temperature of use as a lubricant can be added thereto, for example, organic peroxides, hydroperoxides, or azo compounds. Examples of free radical-forming materials and the temperatures at which they are suitably used can be found in the literature, for example in Houben-Weil, "Methoden der Organischen Chemie", Vol. 141, page 59, or in Brandrup-Immergut, "Polymer Handbook", page II/1-65 (1966). If the lubricant or slip agent is used at elevated temperatures, for example at 100° C. or more, such free radical-forming agents as a rule are not used, but rather the polymerization is initiated using one of the aforementioned types of radiation. In order to facilitate polymerization by visible or ultra-violet light, the lubricant can contain suitable photosensitizers, such as benzoin or azo compounds. The amount of free radical former or sensitizer is chosen at such a level that hardening can take place within a few minutes or seconds.

As examples of unsaturated free radical-polymerizable compounds which are suitable for the purposes of the invention, can be mentioned those vinyl and vinylidene monomers which are used for the preparation of solid polymers, but which are not gaseous at least at room temperature. To this class belong methacrylate esters having 1 to 8 carbon atoms in the alcohol portion, styrene, vinyl esters of lower carboxylic acids (having 2 to 6 carbon atoms), and vinylidene chloride. Acrylate esters or other monomers, which when used alone form soft homopolymers, can optionally be used in admixture with the aforementioned monomers to the extent that the mixture is polymerizable to form a solid non-tacky coating. Hardening is accelerated if at least a portion of the free radically-hardenable compound contains two or more polymerizable double bonds. Examples of such compounds are glycol diacrylates and glycoldimethacrylates, the diacrylates or dimethacrylates of higher glycols, and condensation products having several hydroxy groups, for example, the reaction products of bisphenol A with epichlorohydrin. These diesters are particularly adaptable to photopolymerization with visible or ultra-violet light in the presence of suitable photosensitizers. Since they are nevertheless relatively expensive, the aforementioned simply-unsaturated monomers are preferred.

The free radically-polymerizable monomers can optionally also be used in admixture with limited amounts of solvents or plasticizers. These solvents or plasticizers must be so chosen that they are compatible with the monomers or monomer mixture employed as well as with the polymer which is formed therefrom, i.e. that they form a homogenous phase. Examples of such additives are the aliphatic and aromatic hydrocarbons, oils, chlorohydrocarbons, ketones, esters, alcohols, or water. Examples of useful plasticizers are dioctylphthalate, dibutylphthalate, or the chloroparaffins. The polymerization products formed from mixtures of the monomers with solvents or plasticizers and having a polymer content from above 50 percent to 90 percent are for the most part non-tacky, indeed even partly brittle, solids.

The aforementioned hardenable compounds and their mixtures with solvents or plasticizers are in many cases too fluid for use as lubricants or slip agents. The viscosity of such agents can be raised to any desired value by the addition of dissolved macro-molecular compounds. As the macro-molecular compounds, all materials which form a homogenous mixture with the liquid and/or hardenable components are suitable.

If the lubricant or slip agent is removed from the lubricated surface after hardening, the cheap readily-preparable polymers are above all to be considered as additives. It is particularly advantageous to use the so-called polymer syrups as lubricants or slip agents. These materials can be obtained with any desired viscosity by the partial polymerization of a liquid monomer, such as methylmethacrylate or styrene.

If the hardened lubricant or slip agent is to remain as a protective coating or primer on the lubricated surface, known coating agents which are hardenable by radiation or heat and having a suitable viscosity are used as the lubricant or slip agent. For this purpose it is suitable also to use adhesion-improving additives which themselves are polymerizable, for example acrylic acid or methacrylic acid, or dimethylaminoethylacrylate or dimethylaminoethylmethacrylate.

The lubricants and slip agents can be employed in a broad temperature region according to the invention. Depending on the composition chosen, liquids of suitable viscosity are available even at temperatures far below 0° C. Since the film of lubricant or slip agent in most uses is under high pressure, the boiling temperature of the liquid component of the agent at normal pressures does not in any way constitute an upper limit on the temperature region of use. For example, a 20 percent methylmethacrylate syrup can be employed at temperatures of 160° C. or more, although methylmethacrylate boils at 100° C. In order to avoid spontaneous evaporation of volatile portions prior to hardening, it is recommended to cool the film below the boiling temperature of the mixture shortly before separation of the surfaces lubricated therewith.

The lubricant or slip agent can—according to the requirements in individual cases—have a film thickness between 0.01 and 1 mm. The pressures employed are not limited by the nature of the agent.

The preferred field of use of the lubricants and slip agents of the invention is in forming processes, particularly the deep drawing or pressure-forming of sheet metal, in wire-forming, in the extrusion of metals, and particularly in the shaping of synthetic resins. Synthetic resins often come into sliding contact with the solid surfaces of shaping tools when they are formed by means of positive and/or negative dies, by deep drawing, by stretching when in the thermoelastic condition, by extrusion when in the thermoplastic condition, or by subsequent forming when in a thermoelastic condition. In this way, damage is suffered by the surfaces even at low pressure. At high pressures, for example in the shaping of hollow strands, such strong frictional forces can arise that the material either slips jerkily or does not move at all in the absence of a slip agent. In the aforementioned cases, lubricants and slip agents according to the present invention can be employed to advantage.

After the separation of lubricated surfaces, a thread, a strip, or a web can be imbedded into the still-liquid lubricant or slip agent in order to facilitate the removal of the film after hardening. For the same purpose, a paper layer or a foil can be laid onto the film so that after the film has hardened a protective adhered layer is present which can optionally be kept on the surface until it is further worked.

For a better understanding of the present invention and its many advantages will be had in referring to the following specific examples, given by way of illustration, and referred to the stretching of a lubricated synthetic resin strand.

In the preparation of a biaxially-stretched tube of polymethylmethacrylate, an extruded hollow strand of the resin having a cruciform cross-section, an exterior diameter of 40 mm, and a wall thickness of 9 mm is continuously expanded while in a thermoelastic condition at 140° C. to an exterior diameter of 70 mm by means of an interior pressure of 3 atmospheres gauge. The forward portion of the shaping channel is warmed to 140° C. and, in its rearward part, is cooled to 50° C.–70° C. In the region of entry, an annular groove which surrounds the hollow strand is provided in the side of the inner wall, by means of which a film 200 microns thick of the subsequently-described slip agents is applied under pressure onto the surface of the resin strand.

After a transit time of about 1 minute, the stretched strand, cooled to about 50° C., exits from the shaping channel with a velocity of 50 cm/minute. The major portion of the liquid film of slip agent is removed at the end of the shaping channel by means of an annular rubber rake to give a layer about 15 microns thick. This layer is hardened in an ultraviolet radiation zone 40 cm long and comprising 8 ultraviolet lamps ("Ultra-Vitalux", Osram). The strand then passes between a pair of driving rolls which effect longitudinal stretching in the shaping channel.

The following slip agents were employed. The amounts are reported in parts by weight (=pbw).

EXAMPLE 1

65 pbw of trimethylolpropane triacrylate
35 pbw of a commercial unsaturated polyester resin
3 pbw of benzoin isopropyl ether (as a photoinitiator)

EXAMPLE 2

50 pbw of a commercial unsaturated polyester resin
50 pbw of 2-hydroxpropyl acrylate
5 pbw of benzoin isopropyl ether (as a photoinitiator)

EXAMPLE 3

80 pbw of bisphenol-A-diacrylate
20 pbw of trimethylolpropane triacrylate
4 pbw of benzil dimethyl ketal (as a photoinitiator).

EXAMPLE 4

70 pbw of urethane acrylate
30 pbw of 1,6-hexandiol diacrylate
5 pbw of trichloroacetophenone (as a photoinitiator)

EXAMPLE 5

100 pbw of bisphenol-A-epichlorohydrin-epoxy resin ("Epikote")
10 pbw of dicyandiamide
(This mixture begins to harden at about 150° C. so that, in this case, somewhat lower temperatures are advantageous in the forming channel).

EXAMPLE 6

40 pbw of PVC emulsion, K-value=70
60 pbw of dioctyl phthalate
(The mixture hardens at 180° C. to a tough-elastic coating).

EXAMPLE 7

A liquid mixture of
70 pbw of methylmethacrylate
30 pbw of polymethyl methacrylate, and
2 pbw of dibenzoyl peroxide is used for decreasing the slip resistance between two aluminum sheets which slide across each other at room temperature under a pressure of 200 Newtons/cm$^2$ (1 N=0.102 kg) and at a velocity of 4 cm sec. The mixture has a viscosity of 2500 mPa.s at 20° C. The mixture forms a film about 0.1 mm thick. Lubricated contact is concluded after 20 seconds by separation of the aluminum sheets. The sheets coated with the film of slip agent are warmed by means of infrared radiation to a surface temperature of 80° C.–180° C., whereupon the films harden in a few minutes.

What is claimed is:

1. The method of making a formed strand of thermoplastic synthetic resin having a solidified coating thereon, which method comprises coating an extruded strand of said resin, while in a thermoplastic or thermoelastic condition, with a lubricating layer of a lubricating liquid which can be solidified by heat or radiation, bringing said lubricated synthetic resin strand into sliding contact with a solid surface, whereby form is imparted to said strand, separating the formed strand from said solid surface, and then hardening said layer of lubricating liquid to form a solid coat on said strand.

2. A method as in claim 1 wherein said lubricating liquid comprises an ethylenically-unsaturated compound which is polymerizable by free radicals.

3. A method as in claim 1 wherein said lubricating liquid comprises a polymerization initiator forming free radicals when heated or irradiated with visible or ultra violet light.

4. A method as in claim 1 wherein said lubricating liquid comprises a dissolved macromolecular compound.

5. A method as in claim 1 wherein said lubricating liquid has a viscosity between 1 Pa.s and 500 Pa.s at the temperature at which it is used.

6. A method as in claim 1 wherein said lubricant liquid comprises methyl methacrylate and polymethylmethacrylate.

7. A method as in claim 1 wherein said lubricating liquid comprises at least one mono- or poly-unsaturated free radical-polymerizable monomer having a boiling point above about 150° C.

8. A method as in claim 7 wherein said lubricating liquid further comprises a dissolved saturated or unsaturated resin.

9. A method as in claim 7 wherein said lubricating liquid also comprises a photoinitiator for polymerization.

10. A method as in claim 8 wherein said lubricating liquid also comprises a photoinitiator for polymerization.

* * * * *